US005309961A

United States Patent [19]

Franke et al.

[11] Patent Number: 5,309,961

[45] Date of Patent: May 10, 1994

[54] NOZZLE FOR FILLER PIPES IN PACKAGING MACHINES

[75] Inventors: Rickard Franke, Buffalo Grove, Ill.; Bengt Bengtsson, Eden Prairie, Minn.

[73] Assignee: Tetra Laval Holdings & Finance S.A., Pully, Switzerland

[21] Appl. No.: 45,701

[22] Filed: Apr. 14, 1993

[30] Foreign Application Priority Data

Apr. 27, 1992 [SE] Sweden ..... 9201307

[51] Int. Cl.[5] ..... B65B 3/04; B65D 5/72

[52] U.S. Cl. ..... 141/286; 141/311 A; 141/115; 222/547; 222/494; 222/490; 239/DIG. 12

[58] Field of Search ..... 141/392, 286, 311 A, 141/115; 222/571, 490, 494, 511, 517, 537, 547, 556, 557, 562, 563, 564; 239/DIG. 12, 519; 137/512, 863, 844, 843, 845, 846

[56] References Cited

U.S. PATENT DOCUMENTS

| | | | |
|---|---|---|---|
| 1,987,156 | 1/1935 | Paparello | 222/494 |
| 3,186,451 | 4/1962 | Stanley | 141/360 |
| 3,348,744 | 10/1967 | Morin | 222/494 |
| 3,412,910 | 11/1968 | Hahn | 222/494 |
| 3,754,690 | 8/1973 | Marchant | 222/494 |
| 4,222,417 | 9/1980 | Andersson et al. | 141/392 |
| 4,402,461 | 9/1983 | Mosse et al. | 239/453 |
| 4,608,810 | 9/1986 | Bordini | 53/551 |
| 4,709,836 | 12/1987 | Anderson | 222/490 |
| 4,711,277 | 12/1987 | Clish | 141/311 A |
| 4,877,160 | 10/1989 | Derving | 141/117 X |
| 5,033,647 | 7/1991 | Smith et al. | 222/494 X |
| 5,105,997 | 4/1992 | Wakabayashi et al. | 222/494 |
| 5,141,035 | 8/1992 | Nish et al. | 141/1 |

FOREIGN PATENT DOCUMENTS

| | | | |
|---|---|---|---|
| 199538 | 10/1986 | European Pat. Off. . | |
| 222695 | 5/1987 | European Pat. Off. . | |
| 380251 | 8/1990 | European Pat. Off. . | |
| 490607 | 6/1992 | European Pat. Off. . | |
| 1932497 | 1/1970 | Fed. Rep. of Germany . | |
| 747465 | 6/1933 | France | 222/494 |
| 637435 | 5/1950 | United Kingdom . | |
| 2114711 | 8/1983 | United Kingdom . | |

*Primary Examiner*—Ernest G. Cusick

*Attorney, Agent, or Firm*—Burns, Doane, Swecker & Mathis

[57] ABSTRACT

Nozzles for filler pipes employed in packaging machines of the type which meter a certain quantity of contents, e.g. milk, into individual packages which are advanced stepwise and placed beneath the nozzle of the filler pipe. In order to avoid frothing of the contents, of the nozzle is manufactured from flexible material and includes one or more transverse rigidifying ribs which are of substantially triangular cross sectional configuration and which define two or more separate outlets. The outlets are covered by flaps which are opened by the contents when the contents are caused, with the aid of a metering pump, to flow out through the filler pipe so that the flow of contents is divided and directed towards the vertical walls of the package via which the contents flow down to the bottom of the package with a considerably reduced risk of frothing and spatter as a result.

17 Claims, 3 Drawing Sheets

NOZZLE FOR FILLER PIPES IN PACKAGING MACHINES

FIELD OF THE INVENTION

The present invention relates to a nozzle for filler pipes and more particularly to a nozzle for filler pipes in packaging machines which fills open-topped packages with a determined quantity of liquid contents.

BACKGROUND ART

In the manufacture of certain types of single-use disposable packages or cartons for milk products, the packages are filled with the aid of metering pumps, e.g. piston pumps. On each pump stroke, the pump portions out the desired quantity of contents to a filler pipe connected to the pump. The filler pipe directs the contents down into a package which is to be filled. In such instance, the package may possibly be raised so that it partially surrounds the vertical filler pipe. In order to prevent the contents from leaving the filler pipe too early and in order to avoid dripping after the portioning operation of the desired quantity of contents, the discharge opening of the filler pipe is normally provided with a nozzle with includes means for retaining the column of liquid contents in the filler pipe when the pump is inactive. Such means may, for example, be a nozzle of flexible material, for example an elastomer, having one or more flaps or folds which, during the operative stroke of the pump, are brought into the opened position by the passing liquid contents. A valve unit with a nozzle of this type is disclosed, for instance, in SE 8102088-5.

The nozzle disclosed in the above patent specification has proved to be ideally suitable for use in the portioning out of inhomogeneous contents of a relatively highly viscous nature, e.g. yoghurt with fruit pieces, nuts or the like. However, when nozzles of this type are employed in filler pipes for the portioning out of free-flowing, frothy contents such as low fat milk or skimmed milk, froth formation readily occurs (particularly in rapid filling cycles) which obstructs the filling cycle and raises the possibility that the interior surfaces at the upper region of the package, which are to be subsequently employed for sealing the top of the package, become moist so as to impede or prevent a heat sealing of the mutually facing thermoplastic layers of the package. This froth formation has been found to result because the nozzle fitted with the flaps gives a concentrated, substantially straight downwardly directed jet which, on impinging against the bottom of the package or the progressively rising level of the surface of the contents therein, causes spatter and aeration so that froth is formed.

OBJECTS OF THE INVENTION

One object of the present invention is to provide a nozzle for filler pipes in packaging machines, the nozzle being manufactured from flexible material and comprising flaps openable by the liquid contents, the nozzle not suffering from the above-outlined drawbacks, but being advantageously also employed for filling liquids which show a tendency to froth.

A further object of the present invention is to provide a flexible nozzle of the above-mentioned type which is designed such that it may be employed universally for all types of contents without appreciable modification.

Yet a further object of the present invention is to provide a nozzle whose design and construction are such that its function is not impaired by liquid contents which include relatively large solid or semi-solid particles.

Still a further object of the present invention is to provide a nozzle which is easy to clean and which satisfies extremely stringent requirements of hygiene, for which reason it is suitable for use in packaging machines which handle foods.

SUMMARY OF THE INVENTION

These and other objects have been attained according to the present invention in that a nozzle for filler pipes in packaging machines of the type which fills open-topped packages with a determined quantity of liquid contents is manufactured from flexible material and includes flaps disposed to be opened by the liquid contents. The nozzle has a central, transverse rigidifying rib which forms two or more discrete outlets each one of which has a separate flap.

With the aid of the central, transversely extending rigidifying rib, the flow of contents is divided into two or more partial flows which are directed obliquely outwardly towards the vertical inside surfaces of the package and may thereby flow along these inside surfaces downwardly towards the bottom of the package or the progressively rising level of the liquid surface. As a result the contents will be retarded in flow and have a more laminar flow so that spatter and froth formation will be greatly avoided.

BRIEF DESCRIPTION OF THE DRAWING FIGURES

Preferred embodiments of the nozzle according to the present invention will now be described in greater detail hereinbelow with particular reference to the accompanying, schematic drawing figures which merely show those details necessary for an understanding of the present invention. In the accompanying drawing figures.

DETAILED DESCRIPTION OF PREFERRED EMBODIMENTS

Figure 1A:
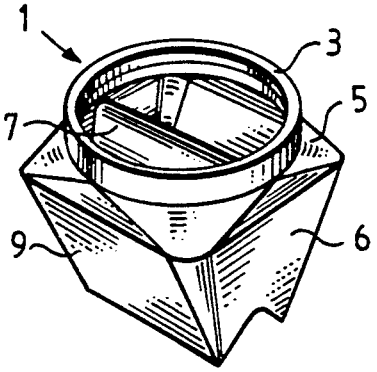
FIG. 1A is a top perspective view of the nozzle according to one embodiment of the present invention.
Figure 1B:
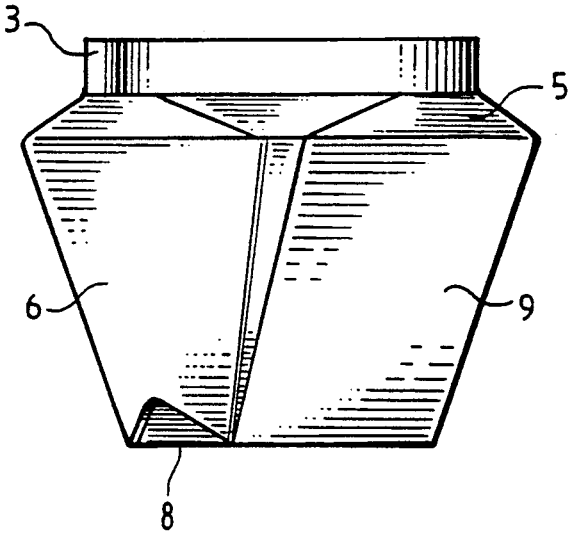
FIG. 1B is a side view of the nozzle illustrated in FIG. 1A.
Figure 1C:
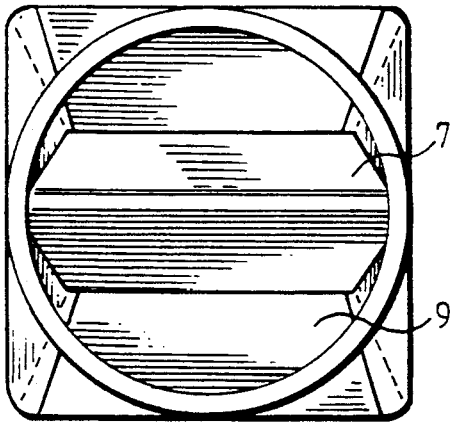
FIG. 1C is a top view of the nozzle illustrated in FIG. 1A.
Figure 1D:
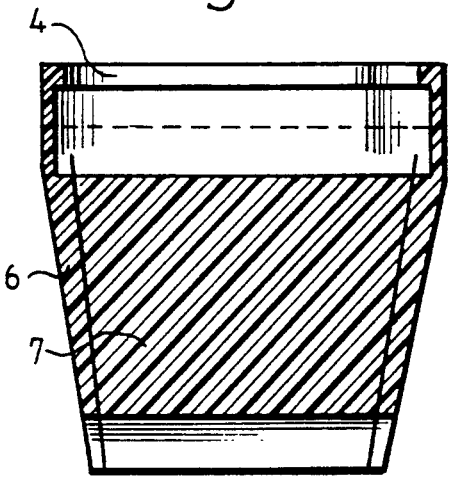
FIG. 1D is a cross-sectional view of the nozzle shown in FIG. 1A along a vertical section line passing through the nozzle.
Figure 1E:
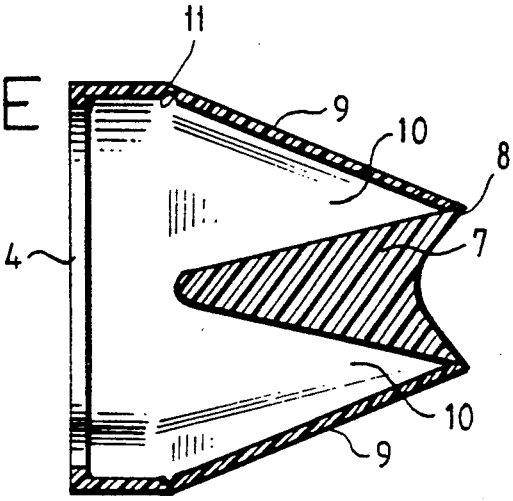
FIG. 1E is a cross-sectional view of the nozzle shown in FIG. 1A along a different vertical section line extending through the nozzle.
Figure 2A:
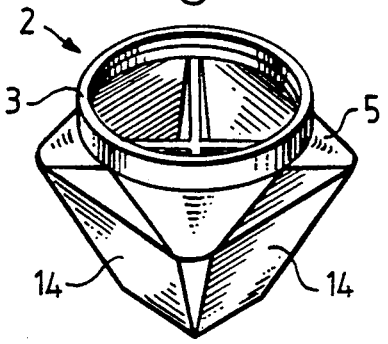
FIG. 2A is a top perspective view of the nozzle according to another embodiment of the present invention.
Figure 2B:
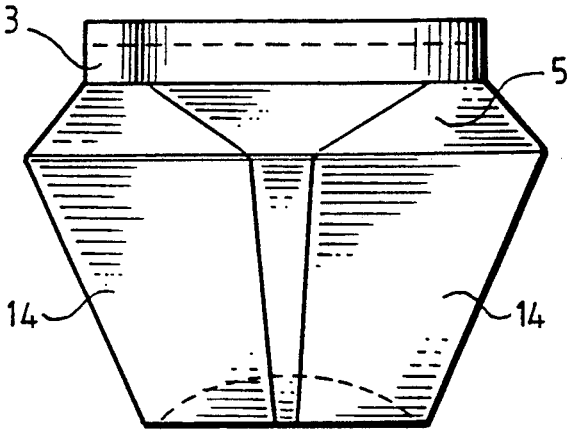
FIG. 2B is a side view of the nozzle illustrated in FIG. 2A.
Figure 2C:
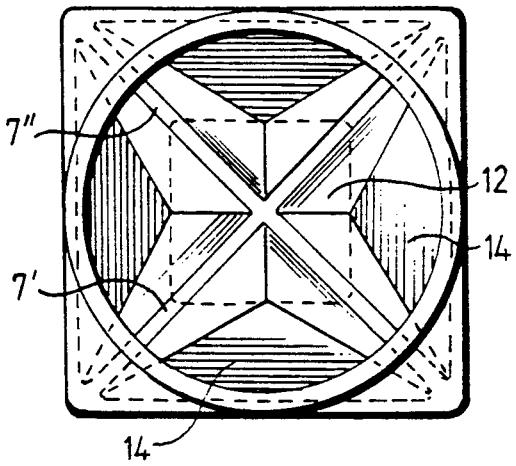
FIG. 2C is a top view of the nozzle illustrated in FIG. 2A.
Figure 2D:
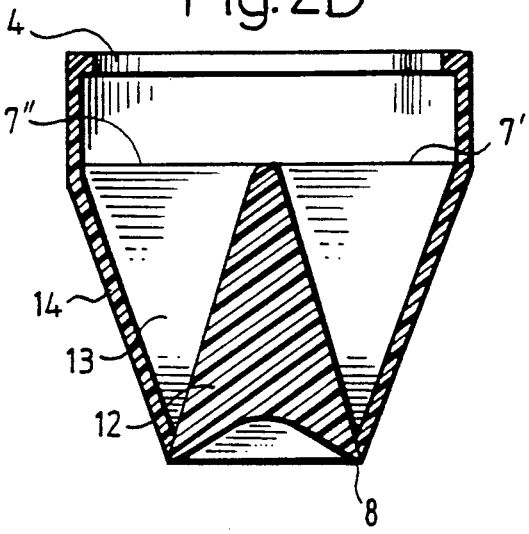
FIG. 2D is a cross-sectional view of the nozzle shown in FIG. 2A along a vertical section line passing through the nozzle.
Figure 2E:
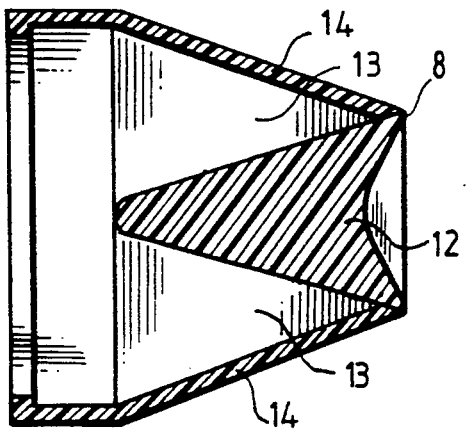
FIG. 2E is a cross-sectional view of the nozzle shown in FIG. 2A along a different vertical section line extending through the nozzle.

The two different embodiments of the nozzle according to the present invention shown in FIGS. 1 and 2 are based on a common inventive concept and are, in principle, designed in a similar manner. As a result, corresponding parts have, as far as practically possible, been given the same reference numerals in the different drawing figures. However, the nozzle illustrated in FIGS. 1A–E has been given reference numeral 1, while the nozzle illustrated in FIGS. 2A–E has been given reference numeral 2. Both the nozzle 1 and the nozzle 2 are manufactured from a flexible material, preferably an elastomer. Since the nozzles are to be employed for the handling of foods, the selection of elastomers is limited to those materials which can be employed without hesitation in contact with foods for human consumption. Preferably, some type of silicon rubber is employed which has proved in practice to possess the desired properties the desired flexibility and is also resistant to cleaning and sterilization agents.

Figure 3:
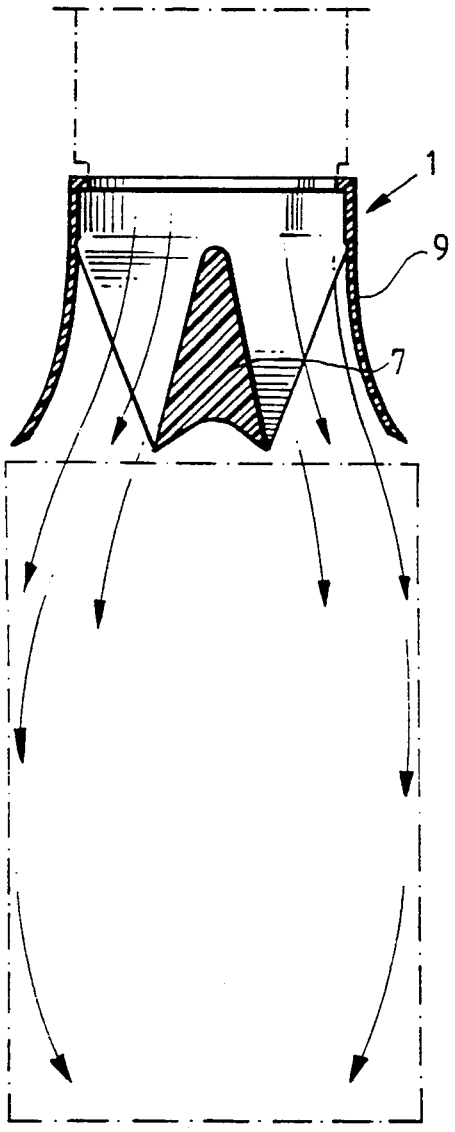
FIG. 3 is a cross-sectional view of the nozzle according to the present invention schematically illustrating the flow of contents through the nozzle during the filling of a package.

The nozzle 1 illustrated in FIGS. 1A–E comprises an anchorage ring 3 which is disposed at its upper end and which is substantially circular and displays an inwardly facing flange 4 by means of which the nozzle can be connected to the lower end of a filler pipe (shown in dot-dash lines in FIG. 3) which is provided with a corresponding outer groove. The anchorage ring 3 consists of an integral part of the nozzle 1 and, immediately beneath the anchorage ring 3, the nozzle 1 merges into a flared portion or shoulder 5 whose cross sectional configuration is substantially quadratic. The lower portion of the nozzle 1 includes two opposing side walls 6 which are slightly angled in relation to one another so that the nozzle tapers somewhat as seen in the direction of movement of the liquid contents. Thus, both of the side walls 6 display such inclination that they are, at their lower end, located somewhat closer to one another than at their upper end adjacent the shoulder 5.

A rigidifying rib 7 located interiorly in the nozzle extends between the two side walls 6 and runs transversely through the nozzle and substantially centrally therein. As is particularly apparent from FIG. 1 E, the rigidifying rib is of substantially triangular cross section and is oriented such that its triangular apex is directed counter to the direction of flow, i.e. upwardly. The acute angle formed by the sides of the rib is between 10° and 50°, the exact angle (number of degrees) being selected in response to the size of the package. In tall packages, for example a smaller angle is selected, since it is possible to make better use of a greater portion of the high side walls in order to obtain a calmer, more laminar flow. In low packages, a greater angle must be selected so as to avoid the risk that the content jets impinge directly on the bottom of the package. In other words, that acute angle is always selected which, together with the relevant package size, results in the lowest rate of flow of the contents and least froth formation in the filling operation. The upper region of the rigidifying rib 7, i.e. the apex of the triangle, is located substantially flush with the shoulder 5, while the lower region of the rigidifying rib 7 forms the bottom 8 of the the nozzle which is preferably somewhat concave or inwardly bulging. Thus, the risk will be avoided that liquid contents are unnecessarily accumulated in contact with the lower region of the nozzle 1.

The remaining, diametrically opposed sides of the nozzle 1 consist of flaps 9 which, in the closed position, abut against both the lower end of the rigidifying rib 7 and the side walls of the nozzle and close off two outlets 10. Each flap 9 consists of an integral part of the flexible nozzle material, and the flap is pivotal about a horizontal hinge joint 11, which is located at the transition between the flap and the shoulder 5, i.e. substantially flush with the upper edge of the rigidifying rib 7. The hinge joint 11 consists of an attenuation or weakening in the nozzle material.

The second embodiment of the nozzle 2 according to the present invention is shown in FIGS. 2A–E and comprises, as was mentioned previously, all of those details and parts which have been described in connection with the foregoing description of the first embodiment of the nozzle. However, as opposed to the nozzle 1, the nozzle 2 has been provided with two rigidifying ribs 7' and 7'' which extend diagonally through the nozzle and thus intersect one another in the central region thereof. The rigidifying ribs 7', 7'' thus run horizontally from corner to corner in the nozzle which is substantially quadratic in cross section. In the central region of the nozzle, the two rigidifying ribs 7' and 7'' will form a central body 12 which is of pyramid shaped appearance with an apex angle which amounts to between 10° and 50°. As in the embodiment according to FIG. 1, the upper edge of the rigidifying ribs 7', 7'' is located substantially flush with the shoulder 5 of the nozzle, while the lower portion of the rigidifying ribs shaped as the central body 12 terminate the nozzle downwardly and form its concave bottom 8.

The two rigidifying ribs 7', 7'' divide the throughflow channel of the nozzle into four outlets 13, each one of which displays a flexible, openable flap 14 which, like the flap 9 in the first embodiment, is pivotally connected to the shoulder 5 of the nozzle. Thus, the flaps 14 together form the opposing sides of the nozzle 2, which, as in the first embodiment of the nozzle according to the present invention, display a certain inclination so that the lower portions of the sides or flaps 14 are, when the nozzle is in the closed position, located somewhat closer to one another than the upper portions of the flaps 14 which are connected to the shoulder 5.

When the nozzle according to the present invention is employed in a filling machine of per se known type, it is mounted to the lower end of a preferably cylindrical filler pipe of stainless steel or other suitable material. The filler pipe may, of course, also be of quadratic or other cross section, in which event the anchorage ring 3 of the nozzle is adapted appropriately to the configuration of the filler pipe. The filler pipe is placed in a packaging machine such that packages can be advanced at regular intervals by means of, for example, a conveyor and be placed beneath the filler pipe. When filling is to take place, the package may possibly be raised so that it partly surrounds the filler pipe. This is a known technique for avoiding unnecessary frothing or splashing during the filling operation. Irrespective of whether the package is lifted up or not, the contents will, on being forced out through the filler pipe by means of a metering pump, force aside the flaps 9, 14 of the nozzle so that they pivot about the joint hinge 11 from the closed position illustrated in FIGS. 1 and 2 to the opened position illustrated in FIG. 3. Thus, the liquid contents may flow in an unimpeded manner through the nozzle, and due to the central rigidifying rib 7, the jet of liquid contents is divided into two or four parts which flow along the vertical walls of the package which is preferably quadratic in cross section, and in contact with the walls down to the bottom of the package as indicated by means of the dot-dash lines and arrows, respectively in FIG. 3. Given that the liquid contents flow in a plurality of partial jets which are directed obliquely outwardly so that the contents first come into contact with the vertical walls of the package, the contents will be retarded in their flow and obtain a more laminar flow, which gives a more even filling and reduced risk of froth formation. This filling technique has proved to be highly advantageous, in particular for liquid contents which show a manifest tendency to froth, e.g. low-fat milk or wine.

When the pump stroke of the metering pump is discontinued, the flow of liquid contents ceases and the outwardly folded flaps 9, 14 may return to the closed position in abutment against the lower end of the rigidifying rib 7 and the adjacent wall portions of the nozzle. In order further to ensure closure of the flaps and to avoid the risk of drip, the liquid contents in the filler pipe can possibly be subjected to some form of partial vacuum, which assists in keeping the flaps in the closed and wholly sealed position. However, this is a known technique which is described for example, in the previously mentioned Patent Specification, for which reason it constitutes no part of the present invention.

While this invention has been illustrated and described in accordance with a preferred embodiment, it is recognized that variations and changes may be made and equivalents employed herein without departing from the invention as set forth in the claims.

What is claimed is:

1. A nozzle for filler pipes used in packaging machines in which open-topped packages are filled with a determined quantity of liquid contents, the nozzle being manufactured from flexible material and including at least two movable flaps disposed to be moved from a closed position to an open position by liquid contents flowing through the nozzle, said nozzle having at least one central, transverse rigidifying rib which forms at least two discrete outlets, each of said outlets being positioned between the rib and one of the at least two flaps.

2. The nozzle as claimed in claim 1, wherein the rib is of substantially triangular cross-section with a triangular apex directed counter to a direction of flow of the liquid contents.

3. The nozzle as claimed in claim 1, including two intersecting ribs and four movable flaps which form four separate outlets, each of the outlets being positioned between a portion of both ribs and one of the four flaps, each of said outlets being closable by one of said four flaps.

4. The nozzle as claimed in claim 3, wherein the ribs intersect one another at 90°, a region of intersection between the ribs having a pyramid configuration.

5. The nozzle as claimed in claim 2, wherein the ribs possess an apex angle of 10°–50°.

6. The nozzle as claimed in claim 1, including a hinge joint associated with each flap for allowing each flap to pivot from the closed position to the open position, said hinge joints being located at a right angle to a longitudinal direction of the nozzle.

7. The nozzle as claimed in claim 6, wherein the hinge joints are located substantially flush with an upper region of the at least one rib.

8. The nozzle as claimed in claim 6, wherein the hinge joints are defined by weakenings in the material of the nozzle.

9. The nozzle as claimed in claim 6, wherein the flaps abut, in the closed position, with their lower ends against a lower region of the rib.

10. The nozzle as claimed in claim 6, wherein the nozzle has a cross-section that is substantially quadratic.

11. A nozzle to be attached to a filler pipe in a filling machine which dispenses a predetermined quantity of contents into open-topped packages, said nozzle having an opening extending therethrough from a top end to a bottom end for allowing contents to flow through the nozzle, said nozzle including a plurality of flaps movable to an open position when the contents flow through the nozzle in order to allow the contents to be discharged into a package through the bottom end of the nozzle, and including means stationarily positioned in an interior of the nozzle and extending from one side of the nozzle interior to an opposite side for outwardly deflecting contents flowing through the nozzle so that the contents are directed towards upstanding walls of the open-topped packages during a filling operation to thereby retard the flow of the contents into the package and inhibit froth formation.

12. The nozzle according to claim 11, wherein said means for outwardly deflecting contents flowing through the nozzle includes a rib extending across the interior of the nozzle to define two outlets in the nozzle, each outlet being bordered by the rib and one of the movable flaps.

13. The nozzle according to claim 12, wherein said rib has a triangular cross-section, an apex of said triangular cross-section being directed towards the top end of the nozzle.

14. The nozzle according to claim 12, wherein said movable flaps abut against a lower end of the rib prior to being moved to the open position by the flow of contents through the nozzle.

15. The nozzle according to claim 11, wherein said means for outwardly deflecting contents flowing through the nozzle includes two ribs extending across the interior of the nozzle, said ribs intersecting one another to define four outlets at the bottom end of the nozzle, each of said outlets being bordered by a portion of one rib, a portion of the other rib and one of the movable flaps.

16. The nozzle according to claim 15, wherein said ribs are triangular in cross-section and extend between oppositely positioned corners of the nozzles.

17. The nozzle according to claim 13, wherein said rib has straight sides that converge towards one another in a direction towards said apex.

* * * * *